United States Patent [19]

Gilbert

[11] Patent Number: 4,687,063

[45] Date of Patent: Aug. 18, 1987

[54] WELL CEMENTING METHOD AND APPARATUS

[75] Inventor: Bruce Gilbert, Houston, Tex.

[73] Assignee: Hughes Tool Company, Houston, Tex.

[21] Appl. No.: 809,354

[22] Filed: Dec. 16, 1985

[51] Int. Cl.[4] ..... F21B 23/06; F21B 33/129

[52] U.S. Cl. ..... 166/382; 166/128; 166/334; 166/123; 166/386

[58] Field of Search ..... 166/382, 386, 217, 206, 166/332, 334, 126, 128, 143, 152, 285, 188, 373

[56] References Cited

U.S. PATENT DOCUMENTS

| | | | |
|---|---|---|---|
| 2,737,248 | 3/1956 | Baker | 166/217 |
| 4,349,701 | 9/1982 | Fish | 166/128 X |
| 4,374,543 | 2/1983 | Richardson | 166/188 X |
| 4,441,559 | 4/1984 | Evans et al. | 166/382 |
| 4,457,369 | 7/1984 | Henderson | 166/217 X |
| 4,469,173 | 9/1984 | Gilbert et al. | 166/188 |
| 4,479,548 | 10/1984 | Gilbert | 166/387 |
| 4,513,822 | 4/1985 | Gilbert | 166/382 |

*Primary Examiner*—Stephen J. Novosad

*Assistant Examiner*—David J. Bagnell

*Attorney, Agent, or Firm*—Charles D. Gunter, Jr.

[57] ABSTRACT

A cementing apparatus is shown for use with a wireline run setting tool. The apparatus includes a retainer with external gripping and sealing members for sealing off a lower region of the well below the sealing members. The cement retainer has a plurality of cementing ports at the lower end thereof which communicate the interior of the retainer with the lower well region. A sliding valve located within the lower end of the retainer can be moved between open and closed positions to control communication of fluids between the interior of the retainer and the lower well region. An inner body is initially received within the interior of the retainer end is retained in position by means of a collet latch. Actuation of the setting tool sets the gripping and sealing elements of the retainer and moves the inner body to shear the collet latch. This action simultaneously closes the cementing ports by moving the sliding valve within the lower end of the cement retainer. The cementing ports can be reopened by inserting the lower end of a tubing string within the interior of the retainer.

7 Claims, 7 Drawing Figures

WELL CEMENTING METHOD AND APPARATUS

BACKGROUND OF THE INVENTION

1. Field of the Invention

This invention relates generally to well cementing devices and, specifically to a wireline conveyed cement retainer which allows circulation of well fluids through the interior of the retainer while running-in to the desired depth in the well bore.

2. Description of the Prior Art

A cement retainer is a tubular member having external gripping and sealing means which can be set within a well bore to seal and grip the surrounding well bore or casing. The retainer is typically provided with a valve which can be used to open and close off cementing ports. The retainer is run on either a wireline or on a tubing string, and the gripping and sealing members can be actuated to seal off an annular space within the well bore between the cement retainer and the surrounding casing. After setting the retainer on a wireline setting tool, the setting tool is removed and a tubing string is lowered into position and inserted within the bore of the set retainer. In a "squeeze cementing" job, cement is then pumped through the tubing string, through the interior of the retainer, and out the cementing ports to seal off perforations in the casing. The retainer valve is then closed to close off the cementing ports and retain the cement below the retainer.

In the prior art devices, it was not generally possible to circulate well fluids through the interior of the retainer as it was being lowered on a wireline to the desired location within the well bore. Because any fluid within the well was required to pass about the exterior of the retainer, and therefore between the gripping and sealing members and the surrounding casing, the retainer tended to "float" while being lowered. This tended to slow the running-in operation and added to the rig time required to set the retainer at the desired location.

The present invention has as its object the provision of a wireline set cement retainer which allows circulation through the interior of the retainer while running the retainer to the desired location within the well bore.

Another object of the present invention is the provision of a simple and reliable release mechanism for releasing the wireline setting tool from the cement retainer after setting the retainer at the desired location within the well bore.

SUMMARY OF THE INVENTION

A well cementing apparatus is shown for use on a wireline setting tool of the type having a power actuated outer sleeve and a cooperating inner tubular member. The apparatus includes a cement retainer having external gripping and sealing means which are engaged by the setting tool outer sleeve for gripping and sealing the surrounding well bore upon opposite relative movement of the setting tool outer sleeve and cooperating inner tubular member to seal off a lower region of the well. The cement retainer has a lower extent with a plurality of cementing ports which communicate the interior of the retainer with the lower well region. A sliding valve located within the lower extent of the cement retainer is slidable between an open position in which the cementing ports communicate the interior of the retainer with the lower well region and a closed position.

An inner body is initially received within the interior of the retainer. The inner body has an upper end engageable with the setting tool inner cooperating member and has a plurality of openings at a lower end thereof which are alignable with the cementing ports of the retainer when the sliding valve is in the open position. Latch means are provided for initially securing the inner body within the retainer with the body openings aligned with the cementing ports to allow circulation of well fluids through the cementing ports and through the interior of the cementing apparatus as the apparatus is being run to the desired setting depth within the well bore.

Preferably, a collet latch is provided for initially securing the inner body within the retainer with the body openings aligned with the cementing ports. The collet latch includes a collet body and a plurality of expansive collet fingers depending therefrom. The collet latch is slidably received about an exterior surface of the inner body with a ramp area of the inner body located beneath the collet fingers to expand the fingers outwardly with respect to the inner body. The collet fingers are provided with outer threaded surfaces which are adapted to engage a mating internally threaded surface of the cement retainer. The collet latch is provided in a collapsible position and is forcibly expanded to the proper thread diameter for engaging the retainer internally threaded surface by forcing the collet fingers over the ramp area. Frangible means releasably connect the collet latch to the inner body with the fingers in the outwardly expanded position.

Additional objects, features and advantages will be apparent in the written description which follows.

BACKGROUND OF THE INVENTION

Figure 2A:
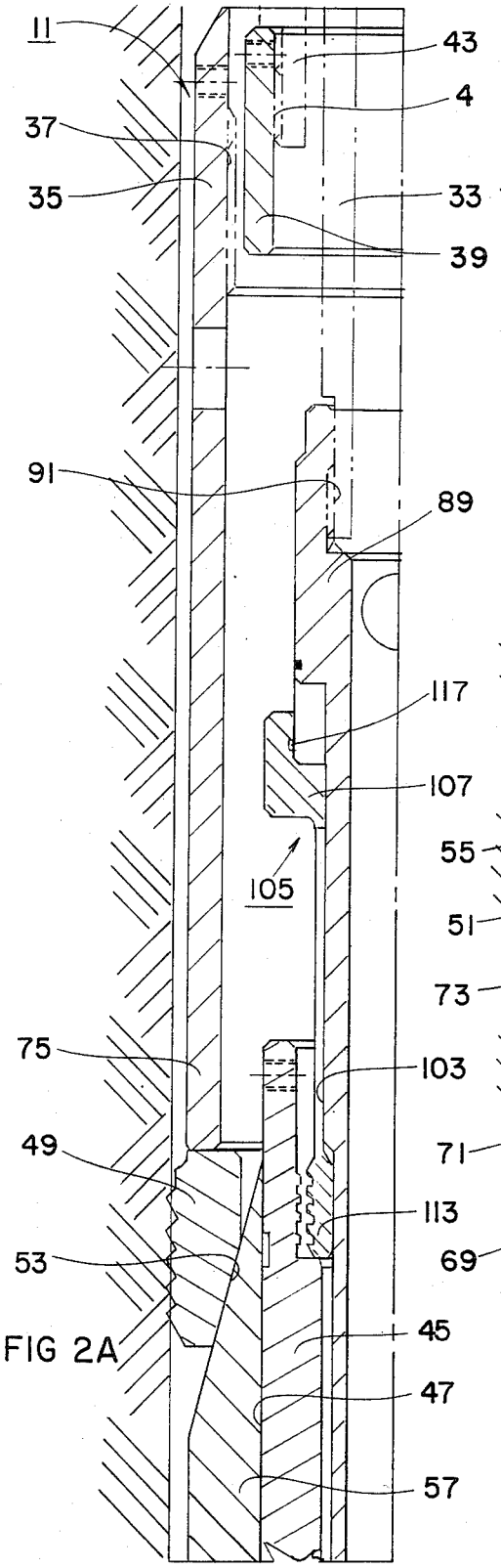
FIG. 2A is a partial, side cross-sectional view of the upper portion of the cementing apparatus with the cementing retainer in the set position.
Figure 2B:
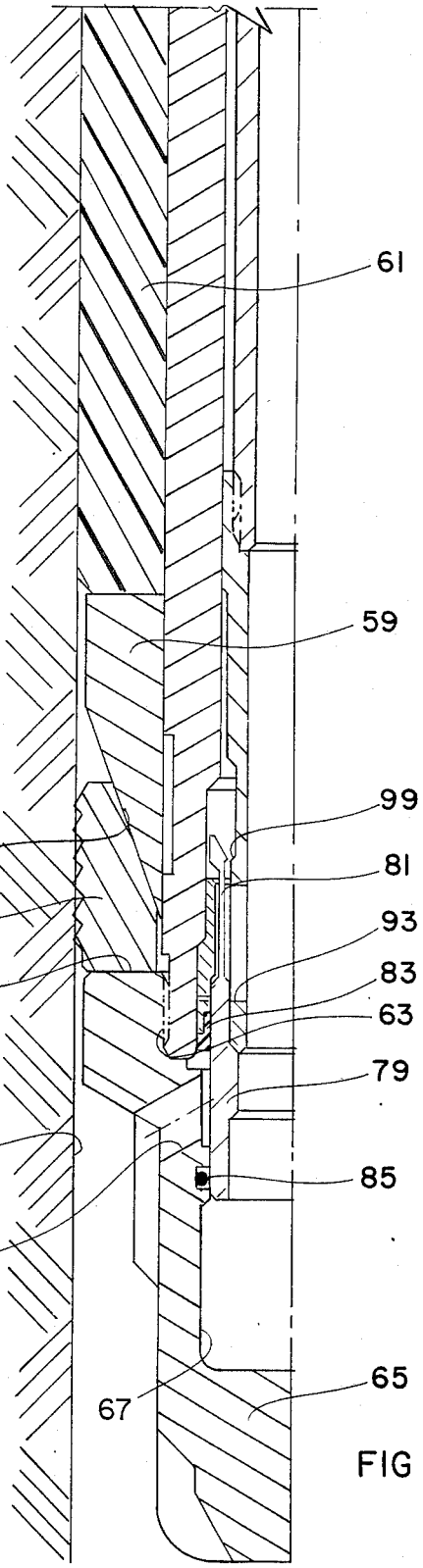
FIG. 2B is a downward continuation of FIG. 2A.
Figure 3A:
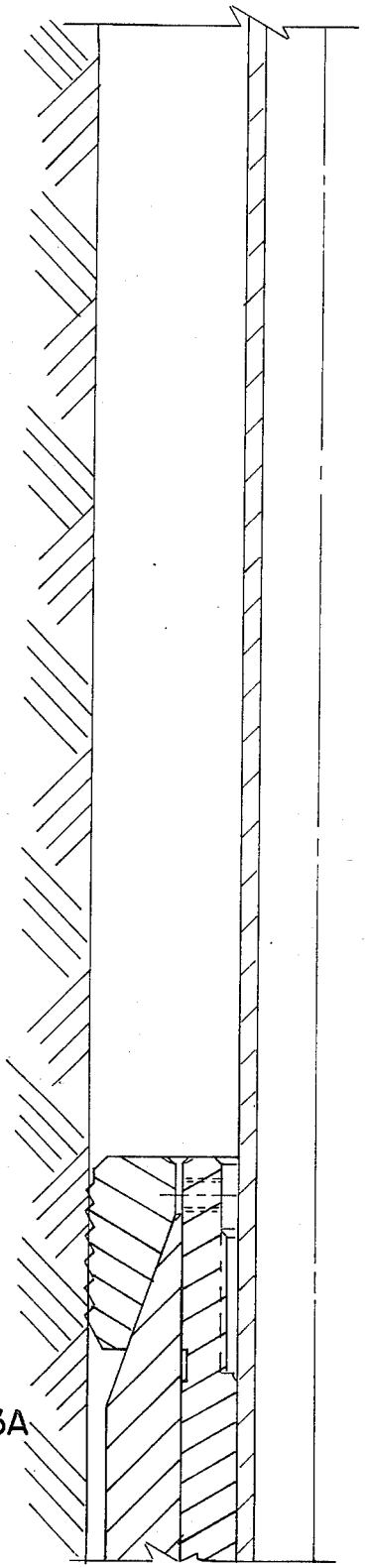
FIG. 3A is a partial, side cross-sectional view similar to FIG. 1A but showing the setting tool removed and a tubing string being inserted within the bore of the cementing retainer.
Figure 3B:
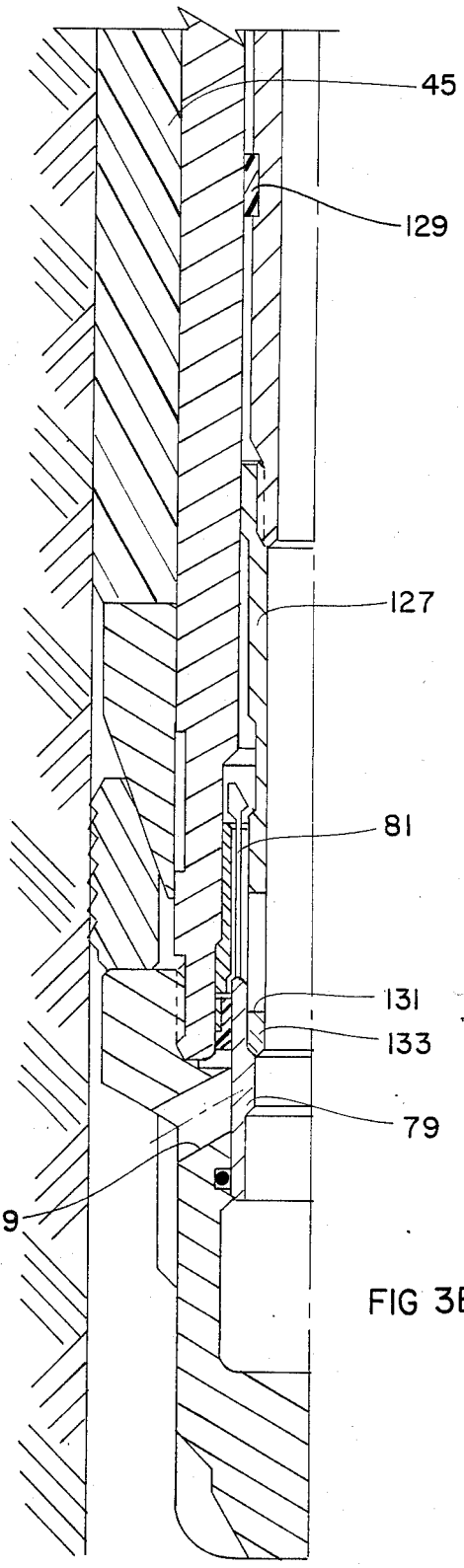
FIG. 3B is a downward continuation of FIG. 3A.
Figure 4:
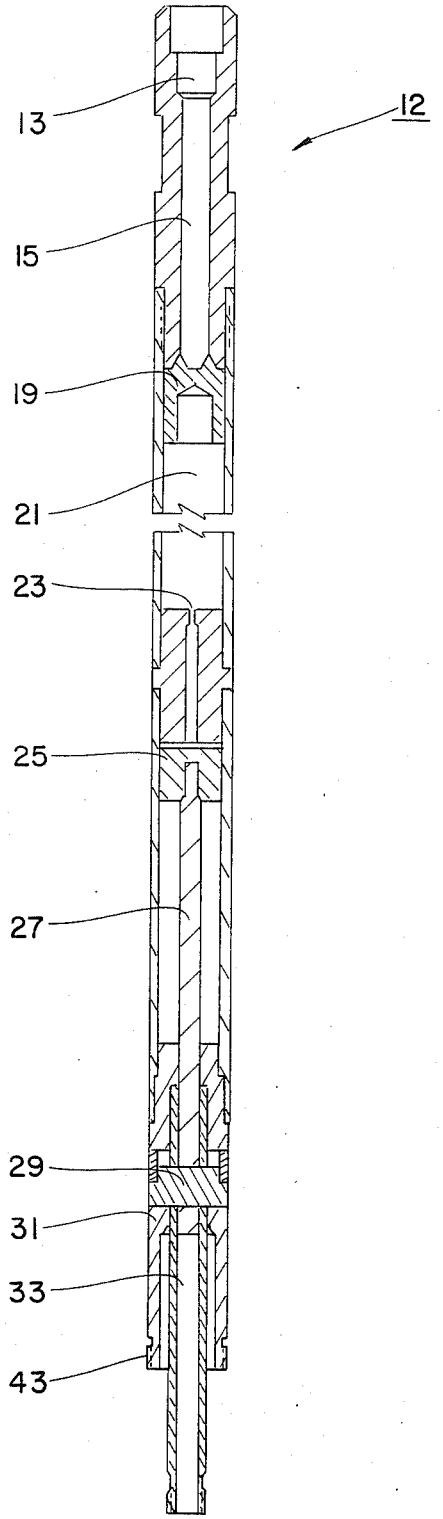
FIG. 4 is a schematic view of a wireline setting tool of the type used with the present invention.

FIGS. 1A–3B show the well cementing apparatus of the invention designated generally as 11. The cementing apparatus 11 is intended for use on a wireline setting tool of the type having a power actuated outer sleeve and a cooperating inner tubular member which is actuated to produce opposite relative movement between the outer sleeve and inner tubular member. Wireline setting tools are well known to those skilled in the art and do not form a part of the present invention. For purposes of illustration, a simplified schematic of a conventional wireline setting tool is shown in FIG. 4.

The setting tool, designated generally as 12, includes a firing head 13 with a gas chamber 15 in which is loaded an explosive charge. A wireline conductor cable (not shown) connects the firing head 13 to a detonating device located at the well surface. Below the gas chamber 15 is located an oil compressing member 19 which forces oil located in an oil chamber 21 through an orifice 23 when the explosive charge is ignited. The oil which is forced through the orifice 23 acts on a piston 25 which is connected through a shaft 27 and a cross-link 29 to a power actuated outer sleeve 31. Movement of the outer sleeve 31 downwardly relative to the inner tubular member 33 provides power setting actuation.

As shown in FIG. 2A, the setting tool is provided with a setting sleeve 35 with internal threads 37 for engaging a bushing 39. The bushing 39 has an internally threaded surface 41 for engaging the outer sleeve 43 (shown in dotted lines in FIG. 2A) of the setting tool.

The cementing apparatus 11 includes a cylindrically shaped retainer 45 having an external surface 47 which carries external gripping and sealing means for gripping and sealing the surrounding well bore upon actuation of the setting tool. The particular gripping and sealing means utilized are well known to those skilled in the art and are shown in simplified form in FIG.'s 1A–3B. Typically, the gripping and sealing means include upper and lower gripping slips 49, 51 which have lower tapered surfaces 53, 55 which rest upon mating tapered surfaces of cones 57, 59. Between the cones 57, 59 is located an expandable elastomeric packer element 61.

The retainer 45 has an externally threaded lower extent 63 for engaging a bottom fitting 65. The bottom fitting 65 is made from a solid metal casing and has an open interior 67 and a plurality of angled cementing ports 69 which communicate the interior 67 with the lower well region 71 between the retainer 45 and the surrounding well casing. This "lower" well region is that region which is lower than the packer element 61 when the packer is expanded to seal off the annulus above the packer (see FIG. 2B).

The gripping and sealing members of the retainer are located between an upper shoulder 73 of the bottom fitting 65 and the lower end 75 of the setting sleeve 35. Downward movement of the setting sleeve 35 relative to the retainer 45 results in outward radial travel of the slips 49, 51 and radial expansion of the packer element 61 to grip and seal the well annulus above the cementing ports 69.

Figure 1B:
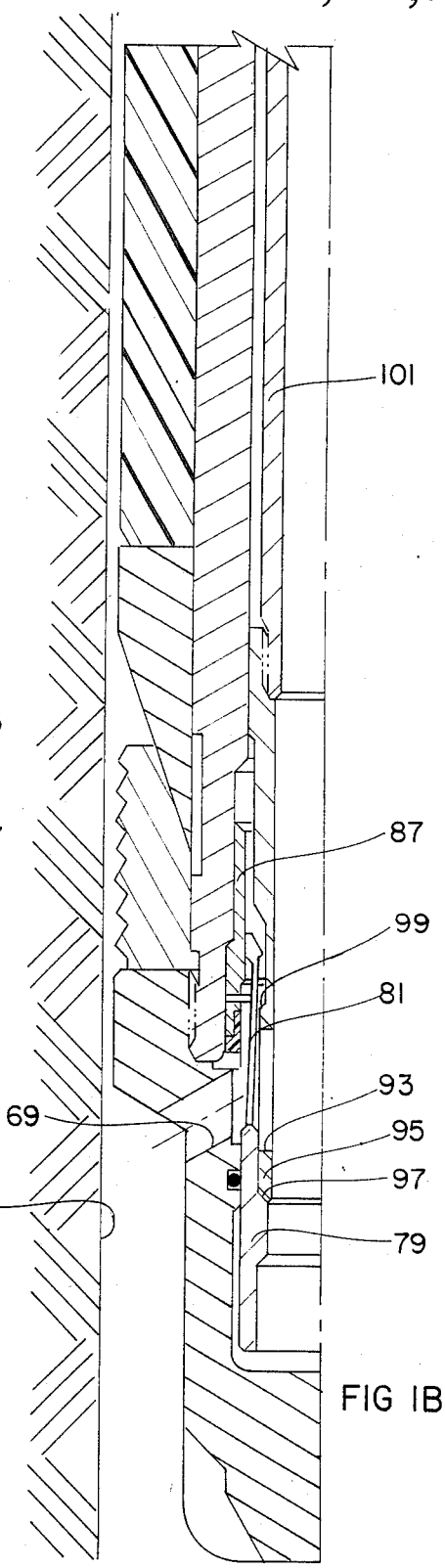
FIG. 1B is a downward continuation of FIG. 1A showing a partial cross-sectional view of the cementing apparatus of the invention.

The retainer 45 also includes a sliding valve located within the lower extent of the cement retainer. The sliding valve preferably comprises a collet body 79 and upwardly extending collet fingers 81. As shown in FIGS. 1B and 2B, the collet valve is slidable between an open position (FIG. 1B) in which the cementing ports 69 communicate the interior 67 of the retainer with the lower well region 71 and a closed position (FIG. 2B) in which the collet body 79 contacts upper packing 83 and O-ring 85 to close-off communication through the cementing ports 69. The collet fingers 81 initially ride on a cylindrical bushing 87 within the interior of the retainer 45.

Figure 1A:
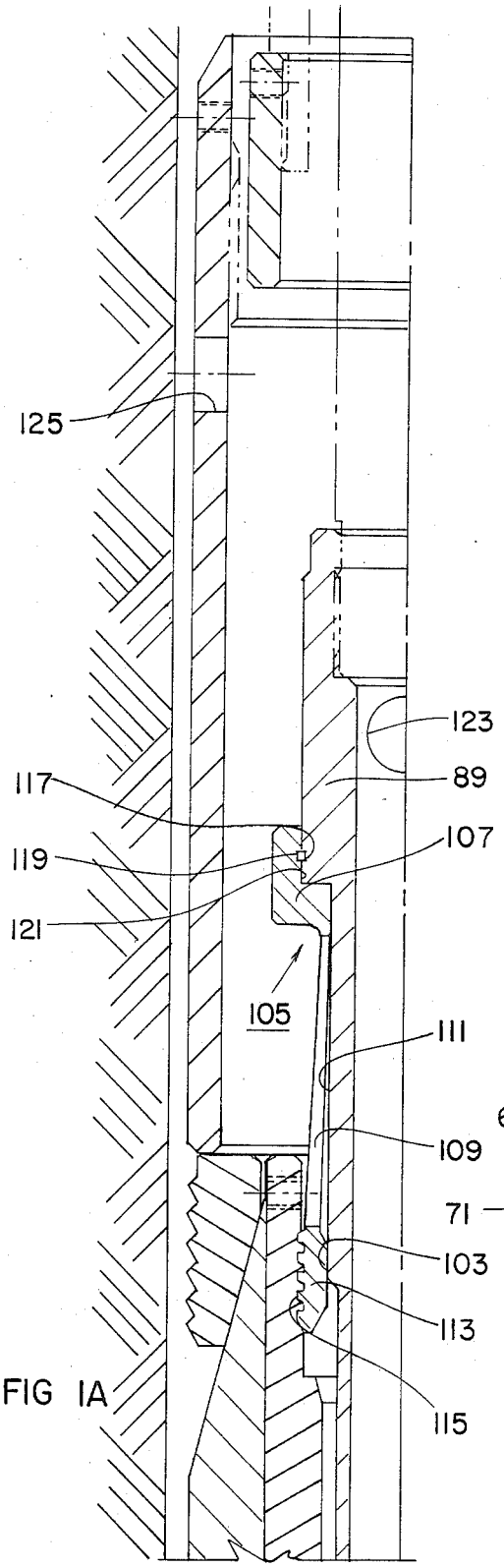
FIG. 1A is a partial, side cross-sectional view of the upper portion of the cementing apparatus of the invention in the running-in position.

The cementing apparatus 11 also includes an inner body 89 which has an internally threaded upper end 91 which is engageable with the setting tool inner cooperating member (shown in dotted lines in FIG. 1A). The inner body 89 has a plurality of openings 93 at a lower end thereof which are initially aligned with the cementing ports 69 of the retainer when the sliding valve is in the open position shown in FIG. 1B. The lower end 95 of the inner body 89 rests on an internal shoulder 97 of the collet body 79, thereby securing the collet valve in the open position shown in FIG. 1B. The inner body also has an external shoulder 99 which underlies the collet fingers 81 in the position shown in FIG. 1B.

The upper portion 101 of the inner body 89 has a region of lesser external diameter which is joined to a region of greater external diameter to form a ramp area 103. A collet latch 105 is initially secured about the inner body within the retainer. The collet latch 105 includes a collet body 107 and a plurality of expansive collet fingers 109 depending therefrom. The collet latch is slidably received about the exterior surface 111 of the inner body with the ramp area 103 beneath the lower extents 113 of the collet fingers to expand the fingers outwardly with respect to the inner body.

The collet fingers 109 are provided with outer threaded surfaces 115 which are adapted to engage mating internally threaded surfaces of the cement retainer. The collet latch is provided in a collapsible position and is forcibly expanded to the proper thread diameter for engaging the retainer internally threaded surface by forcing the collet fingers 113 over the ramp area 103.

The collet latch is releasably connected to the inner body 89 by a frangible means so that the collet fingers 109 are maintained in the outwardly expanded position. Preferably, the frangible means is a square shear wire 117 located in a circumferential keyway 119 provided between the inner body exterior surface and an interior surface 121 of the latch collet body 107, whereby the collet is rotatable about the inner body. The shear wire 117 has a preselected shear resistance selected to sever upon the application of a predetermined setting force from the setting tool.

The operation of the cementing apparatus of the invention in a typical "squeeze cementing" job will now be described. The cementing apparatus 11 is lowered to the desired depth within the well bore on a wireline setting tool (12 in FIG. 4) with the outer sleeve 43 engaging the setting sleeve 35 and with the inner tubular member 33 engaging the inner body 89. In the running-in position shown in FIGS. 1A and 1B, the inner body is retained in the position shown by the collet latch 105 with the outer threaded surface 115 of the collet fingers engaging the internally threaded surface of the inner body and with the shear wire 117 fixing the collet body 107 to the inner body 89. The lower end 95 of the inner body rests on the internal shoulder 97 of the collet body 79, thereby allowing fluid communication through the cementing ports 69, past the collet fingers 81, and through the openings 93 in the inner body 89. As a result, well bore fluids can circulate from the lower well region 71 through the interior of the inner body, out the body openings 123, and out the ports 125 to the region above the cementing apparatus.

Once the desired depth has been reached, an electric signal is sent through the connecting cable to the setting tool to actuate the setting charge. The resulting opposite relative movement between the outer sleeve 31 and inner tubular member 33 causes the setting sleeve 35 to set the slips and packer 49, 51 and 61, respectively (FIG. 2A–2B). This seals off the lower well region 71 below the packer 61 from the well annulus 70 above the packer. Once the predetermined shear resistance of the shear wire 117 is exceeded, the ramp area 103 moves from beneath the lower extents 113 of the collet latch 105, thereby releasing the inner body 89.

As the inner body moves upwardly, the external shoulder 99 engages the collet fingers 81 raising the collet body 79 from the position shown in Fig. 1B to the position shown in FIG. 2B. In this position, the collet body 79 sealingly engages the O-ring 85 and packing 83 to close off fluid communication between the interior 67 and cementing port 69. The setting tool and inner body can now be retrieved to the well surface.

A shifter sub/seal assembly on a tubing string would now typically be inserted within the bore of the inner body 89 which remains behind within the well bore. FIGS. 3A–3B show such a tubing string 127 havinq an external seal l29 for slidingly engaging the internal bore of the retainer 45. The tubing string 127 is also provided with a plurality of openings l31 identical to the openings 93 in the inner body 89. As the tubing string 127 is inserted within the bore of the inner body 89, the lower end 133 of the tubing string 127 acts as a shifter sub and again engages the collet body 79 and moves the collet body from the closed position shown in FIG. 3B to the open position shown in FIG. 1B.

Cement can now be pumped through the tubing string 127 from the well surface, through the interior of the retainer, and through the openings 13l and cementing ports 69 to the lower well region 71. The casing has typically been perforated at this point, and the cement is "squeezed" through the perforations into the surrounding formation. Once cementing is complete, the tubing string 127 can be raised to the well surface. Upward movement of the lower end 133 again engages the collect fingers 81, moving the collect body to the closed position shown in FIG. 3B. This action closes the cementing ports 69 and prevents the cement from flowing back up the tubing string.

An invention has been provided with several advantages. The wireline actuated cement retainer can be run into position in the well bore while allowing circulation of well bore fluids through the interior of the retainer. Because well fluids can circulate through the retainer, the apparatus can be run into position much more quickly than with prior art devices. This results in a savings in rig time. The collect latch used to secure the inner body to the retainer is simple in design and reliable in operation. Firing the setting tool automatically releases the inner body of the cementing apparatus and closes off the cementing ports. Introduction of a shifter sub/seal assembly on a tubing string within the interior of the retainer automatically reopens the cementing ports for cementing operations. Retrieval of the tubing string to the well surface again closes off the cementing ports and retains the cement in position. The retainer can be made of cast iron and can be drilled out once the squeeze cementing operation is complete. The retainer can also be used to inject other fluid slurries, such as acid treatments, into a well bore by operating the retainer in the manner previously described.

While the invention has been shown in only one of its forms, it is not thus limited but is susceptible to various changes and modifications without departing from the spirit thereof.

I claim:

1. A fluid slurry retaining apparatus for use on a wireline setting tool in a well, the setting tool being of the type having a power actuated outer sleeve and a cooperating inner tubular member, comprising:

a retainer having external gripping and sealing means engageable with the setting tool outer sleeve for gripping and sealing the surrounding well bore upon opposite relative movement of the setting tool outer sleeve and cooperating inner tubular member to seal off a lower region of the well from an upper annular region, the retainer having a solid lower extent with an open interior and a plurality of ports which communicate the interior of the retainer with the lower well region;

a sliding valve located within the lower extent of the retainer, the sliding valve comprising a collect body and upwardly extending collect fingers, the valve being slidable between an open position in which the ports communicate the interior of the retainer with the lower well region and a closed position in which the collect body closes off communication through the ports;

an inner body initially received within the interior of the retainer, the inner body having an upper end engageable with the setting tool inner cooperating member and having a plurality of openings at a lower end thereof which are alignable with the ports of the retainer when the sliding valve is in the open position, the upper end having an exterior surface with an external ramp area formed in a portion of the exterior; and a collect latch initially securing the inner body within the retainer with the body openings aligned with the ports to allow circulation of well fluids through the ports and through the interior of the apparatus as the apparatus is being run to the desired setting depth within the well bore, the collet latch having a collet body and a plurality of expansive collet fingers depending therefrom, the collet latch being slidably received about the exterior surface of the inner body with the ramp area beneath the collect fingers to expand the fingers outwardly with respect to the inner body, the collet fingers being provided with outer threaded surfaces adapted to engage a mating internally threaded surface of the retainer, the collect latch being provided in a collapsible position and being forcibly expanded to the proper thread diameter for engaging the retainer internally threaded surface by forcing the collet fingers over the ramp area.

2. A well cementing apparatus for use on a wireline setting tool of the type having a power actuated outer sleeve and a cooperating inner tubular member, comprising:

a cement retainer having external gripping and sealing means engageable with the setting tool outer sleeve for gripping and sealing the surrounding well bore upon opposite relative movement of the setting tool outer sleeve and cooperating inner tubular member to seal off a lower region of the well, the cement retainer having a solid lower extent with an open interior and with a plurality of cementing ports which communicate the interior of the retainer with the lower well region;

a sliding valve located within the lower extent of the cement retainer, the sliding valve comprising a collet body and upwardly extending collet fingers, the valve being slidable between an open position in which the cementing ports communicate the interior of the retainer with the lower well region and a closed position in which the collet body closes off communication through the cementing ports;

an inner body initially received within the interior of the retainer, the inner body having an upper end engageable with the setting tool inner cooperating member and having a plurality of openings at a lower end thereof which are alignable with the cementing ports of the retainer when the sliding valve is in the open position, the upper end having an exterior surface with an external ramp area formed in a portion of the exterior;

a collet latch initially securing the inner body within the retainer with the body openings aligned with the cementing ports to allow circulation of well fluids through the cementing ports and through the interior of the cementing apparatus as the apparatus is being run to the desired setting depth within the well bore, the collet latch having a collet body and a plurality of expansive collet fingers depending thereform, the collet latch being slidably received about the exterior surface of the inner body with the ramp area beneath the collet fingers to expand the fingers outwardly with respect to the inner body, the collet fingers being provided with outer threaded surfaces adapted to engage a mating internally threaded surface of the cement retainer, the collet latch being provided in a collapsible position and being forceably expanded to the proper thread diameter for engaging the retainer internally threaded surface by forcing the collet fingers over the ramp area; and frangible means for releasably connecting the collet latch to the inner body with the fingers in the outwardly expanded position.

3. The well cementing apparatus of claim 2, wherein the inner body has upper connecting means for connection to mating connecting means on the setting tool inner cooperating member, whereby actuation of the setting tool serves to move the setting sleeve and inner body in opposite relative directions to sever the frangible means and move the ramp area from beneath the fingers of the latch collet to disengage the latch collet and allow the inner body to be withdrawn from the retainer interior.

4. The well cementing apparatus of claim 3, wherein the frangible means is a square shear wire located in a circumferential keyway provided between the inner body exterior surface and in interior surface of the latch collet body, whereby the collet is rotatable about the inner body, the square shear wire having a preselected shear resistance selected to sever upon the application of a predetermined setting force from the setting tool.

5. A method of setting a cement retainer on a wireline actuated setting tool having a power actuated outer sleeve and a cooperating inner tubular member, the cement retainer having external gripping and sealing means which are actuated by the outer sleeve of the setting tool for sealing off a lower region of the well below the sealing means for cementing, the method comprising the steps of:

providing the cement retainer with a plurality of cementing ports which communicate the interior of the retainer with the lower well region;

positioning a sliding valve within a lower extent of the retainer, the valve being slidable between an open position in which the cementing ports communicate the interior of the retainer with the lower well region and a closed position;

providing an inner body within the cement retainer having upper connecting means which are engageable with the setting tool inner tubular member, the inner body being provided with a plurality of openings at a lower end thereof which are alignable with the cementing ports when the sliding valve is in the open position;

latching the inner body within the retainer with frangible latch means so that the inner body openings are aligned with the cementing ports and the sliding valve is in the open position; and running the cement retainer to the desired depth within the well on the wireline setting tool while allowing circulation of well fluids through the cementing ports, through the sliding valve and the inner body openings, and upwardly and out of the cementing retainer to facilitate running the retainer to the desired depth.

6. The method of claim 5, further comprising the steps of:

actuating the setting tool to cause opposite relative movement between the outer sleeve and inner tubular member to set the gripping and sealing means on the retainer exterior and shear the frangible latch means, thereby allowing upward sliding movement of the inner body from within the retainer; and engaging the sliding valve on the inner body, so that upward movement of the inner body moves the sliding valve to the closed position to thereby close off communication between the interior of the retainer and the lower well region through the cementing ports.

7. The method of claim 6, further comprising the steps of:

withdrawing the inner body from the well by raising the setting tool on the wireline to the well surface; and inserting the lower end of a string of tubing within the interior of the retainer, thereby engaging the sliding valve and again moving the sliding valve to the open position, the lower end of the tubing string being provided with openings for communicating with the lower well region through the cementing ports.

* * * * *